US005524532A

United States Patent [19]

Koivukunnas et al.

[11] Patent Number: 5,524,532

[45] Date of Patent: Jun. 11, 1996

[54] METHOD AND APPARATUS FOR CALENDERING A PAPER OR BOARD WEB

[75] Inventors: Pekka Koivukunnas, Järvenpää ; Markku Ellilä, Helsinki, both of Finland

[73] Assignee: Valmet Corporation, Helsinki, Finland

[21] Appl. No.: 364,690

[22] Filed: Dec. 28, 1994

[51] Int. Cl.[6] ..... B30B 15/34; D21G 1/00

[52] U.S. Cl. ..... 100/38; 100/93 RP; 100/161; 162/206

[58] Field of Search ..... 100/38, 92, 93 R, 100/93 RP, 155 R, 161; 162/205–207

[56] References Cited

U.S. PATENT DOCUMENTS

| | | | |
|---|---|---|---|
| 2,251,890 | 8/1941 | Montgomery | 162/206 |
| 4,606,264 | 8/1986 | Agronin et al. | 100/38 |
| 4,653,395 | 3/1987 | Verkasalo | 100/38 |
| 4,738,197 | 4/1988 | Mälkiä | 100/38 |
| 4,932,139 | 6/1990 | Lehtinen | 34/41 |
| 5,033,373 | 7/1991 | Brendel et al. | 100/38 |
| 5,378,497 | 1/1995 | Johnson et al. | 162/206 |

FOREIGN PATENT DOCUMENTS

| | | |
|---|---|---|
| 80102 | 12/1989 | Finland . |
| 84509 | 5/1991 | Finland . |
| 4126233 | 9/1992 | Germany . |
| 4112537 | 10/1992 | Germany . |

OTHER PUBLICATIONS

Lehtinen, Jukka "The heat pipe process in intraweb heat transfer in hot–surface paper drying", Paper and Timber vol. 74/No. 7/1992.

Lehtinen, Jukka A. "Some structural effects on the diffusional and fluid flow frictional resistance of paper webs undergoing hot–surface drying", no date.

Lehtinen, Jukka "Further development of a computer program simulating heat pipe functioning in condebelt paper drying", Drying Technology, 10(4), 1037–1062 (1992).

*Primary Examiner*—Stephen F. Gerrity

*Attorney, Agent, or Firm*—Cohen, Pontani, Lieberman, Pavane

[57] ABSTRACT

In the inventive method and apparatus for calendering a surface of a paper or board web, a temperature difference is created between the web surfaces so that the surface to be calendered is cooler than the opposite surface. In addition, moisture within the web is transferred using the so-called heat pipe effect toward the cooler surface while substantially preventing evaporation of moisture from the web so as to create a predetermined moisture profile transversely through the web and decrease the glass transition temperature of the web at the relatively cooler surface to be calendered. Finally, the web having the predetermined moisture profile is advanced into the calendering nip so that the relatively cooler and moister surface of the web is pressed against the heated roll of the nip to thereby calender that web surface.

29 Claims, 6 Drawing Sheets

METHOD AND APPARATUS FOR CALENDERING A PAPER OR BOARD WEB

FIELD OF THE INVENTION

The present invention relates to methods and apparatus for the calendering of a paper or board web.

BACKGROUND OF THE INVENTION

Through the calendering of paper, an effort is made to further improve the quality of paper theretofore formed or, in providing a standard level of quality, to achieve a higher running speed or increased bulk of the paper being produced. It is well known that the plasticity or molding tendency of paper may be increased by raising the temperature and/or the moisture content of the paper. A considerable change in plasticity occurs when the temperature of the polymers contained in the paper rises to or beyond the so-called glass transition temperature, at which point the paper may then be more readily molded or formed or finished than it can below that temperature. It is also known that an increase in the moisture content of paper lowers the glass transition temperature. Thus, the paper web is commonly heated in a calender nip by means of a heatable roll, i.e. a so-called thermoroll, and optionally, in addition, by way of a steam treatment before or upstream of the nip. A steam treatment also desirably increases the moisture content of the paper, thereby lowering the glass transition temperature and enhancing the moldability of the paper. However, it is also recognized that at high running speeds the paper does not have an adequate opportunity to be sufficiently heated as it passes through the nip and, moreover, the effects of a steam treatment are typically lost to the environment before the paper reaches the calender.

Thus, the effect of the calendering process on a paper web is highly dependent on the moisture content and the temperature of the fibers contained in and forming the paper at the moment of calendering since the moldability of the fibers markedly, and somewhat disproportionately, increases when their temperature reaches the glass transition temperature and, in addition, the glass transition temperature is directly proportional to the moisture content of the fibers. Above the glass transition temperature it is relatively easy to produce permanent deformations of the fibers whereas, below that temperature, such deformations tend to be reversible. In order to ensure the permanence of the desired calendering effects, the web must accordingly be moistened to lower the glass transition temperature and, in addition, very high calendering temperatures and high pressures must be applied to the web so as to assure that the entire web readily exceeds the glass transition temperature and to provide for uniform deformation of the fibers through the entire cross-section of the web.

The prior art is replete with teachings having the goal of assuring permanence and uniformity of fiber deformation in the production of a paper web. German Patent No. 4,126,233, for example, is directed to a method and apparatus for glazing a paper web. The web is first heated by means of heat radiators so that the web surfaces attain a plasticization temperature, following which the paper web is passed between a pair of rolls which define a nip in which the web is pressed and cooled.

U.S. Pat. No. 5,033,373 discloses a calender including two successively-disposed nips for glazing both (i.e. opposite) sides or surfaces of a paper web. Before entering one of the nips, the paper is cooled by means of a cooling device and, after the web has cooled, that side or face of the web about to contact the hot nip roll is heated by a heating device, preferably by means of a heat radiator or a hot air jet. This heating is intended to make the web surface as hot as possible before it enters the calendering nip.

The art also discloses various methods and apparatus for confining the deformation of the web fibers to only the surface portions of the web. U.S. Pat. No. 4,606,264, for example, provides a method and apparatus for temperature gradient calendering, wherein paper or like material is passed into at least one nip formed by an iron roll and a soft roll. The iron roll is heated to at least that temperature at which the fibers in the web begin to deform; for paper, that temperature is approximately 350° F. As therein disclosed, it is preferred that the web is passed through two successive nips, one for glazing one face of the web and the other for glazing the opposite face.

These prior art methods, however, are neither concerned with nor directed to predeterminately affecting or varying the distribution of moisture within and through a paper web but, rather, merely relate to the distribution of temperature in the web.

It would be notably easier to limit the moldability of the fibers to only the intended surface portions or regions of a paper web if one could assure a transverse moisture distribution in the web characterized by a considerably higher moisture content, at or proximate the surface layer of the paper on that side or face to be calendered, relative to the opposite side or face and to the web interior. Such a moisture distribution would render that side or face of the paper to be glazed substantially more readily moldable than other parts of the web. The typical but largely undesired thinning of the web that results from conventional calendering processes could then be readily minimized.

Moistening of the web with steam may, for example, at least initially be viewed as one possible alternative to solving the aforedescribed problem. Such a procedure, however, often raises other difficulties. Thus, in board machines the temperature of the web before or upstream of a calender is typically approximately 90° C., making it difficult to achieve adequate condensation of steam in the web and to create a clear moisture gradient.

Prior attempts to improve the calendering properties of paper have proposed the addition of microcapsules—which will release the water they contain when subjected to high pressure in a calender nip—to a coating agent that is applied to the paper. Finnish Patent No. 84,509 discloses such a method for moistening a paper web in which water-containing microcapsules are provided in the surface structural layer of the web; the capsules are broken during the calendering process to thereby release water onto the web. The capsules, which comprise a frangible, water-impermeable shell defining a hollow water-containing interior, are added to the coating slip of the paper web. Such procedures have not, however, proven to be entirely satisfactory in practice.

There is accordingly a need in the art for a method of attaining, for use in the calendering process, a predetermined distribution of moisture content in and through a paper web in the thickness direction of the web. The desired internal moisture distribution is such that the web surface to be calendered is considerably moister than the opposite surface of the web and the web interior.

A method of forming a moisture distribution in the web drying art is currently known and marketed under the trademark Condebelt, and is described by way of example in Finnish Patent No. 80,102 and its corresponding U.S. Pat.

No. 4,932,139. These references teach a method and apparatus for drying a fibrous web between two substantially parallel metal bands that move in the same direction. The fibrous web is passed or carried, together with a felt, between the opposed moving bands while the band on the web side (i.e. contacting the web) is heated and the band on the felt side (i.e. contacting the felt) is cooled, to thereby dry the web. More particularly, the water present in the web is evaporated by the hot metal band and is then transferred into the felt under the pressure of the resulting steam, simultaneously forcing the water ahead of it. The steam so transferred into the felt condenses by virtue of the cooled band, thus drying the web through the transfer of water from the web into the felt.

No such methods or apparatus for achieving a predetermined or suitable moisture distribution in a web in a calendering process, however, are taught or currently practiced in the art.

OBJECTS AND SUMMARY OF THE INVENTION

It is accordingly the desideratum of the present invention to provide an improved method and apparatus for calendering a paper web by which the drawbacks and deficiencies of the prior art are minimized or substantially eliminated. It is a particular object of the invention to provide such an improved method and apparatus for calendering a paper web in which the effects of the calendering process are primarily limited to the surface of the web being calendered.

It is also an object of the invention to provide a method and apparatus for calendering a paper web in which the web attains an advantageous distribution of moisture such that the web surface to be calendered is rendered more moist than inner portions and the opposite surface of the web, thus lowering the glass transition temperature primarily in those predetermined portions of the web to be calendered.

A further object of the invention is to provide a method and apparatus through which calendering of the web is carried out at an effectively reduced temperature to assure the permanence and consistency of the fiber deformation.

Yet another object of the invention is to provide such a method and apparatus in which a predetermined internal distribution of moisture in the web is attainable in a reliable and readily implementable arrangement suitable for commercial environments.

These and other objects of the invention are achieved in a method and apparatus in which, before the web enters a calendering nip, a temperature difference is produced between the surfaces of the web by heating or cooling one side or surface of the web such that the web surface to be calendered is disposed on the side of the relatively lower temperature. When the web runs or advances between two substantially airtight faces in contact with the opposed web surfaces during this treatment, the so-called heat pipe process occurs in the web and the moisture present in the web is thereby transferred through the web toward the surface on the side of the lower temperature. Thus, the moisture contained in the paper is transferred along the pores of the paper from the hotter side or surface toward the surface layers of the colder or cooler side, whereby the water content of the web surface facing the counter roll—i.e. the surface opposite that to be calendered—decreases. In this manner, the glass transition temperature on the web surface to be heat-treated or calendered decreases and the moldability of the fibers on that surface is correspondingly improved, while the fiber moldability is impaired on the opposite web surface against or on the side of the counter roll. Moreover, the inventive method and apparatus produces a moisture distribution in and through the thickness direction of the web that predeterminately varies—preferably in a generally linear manner—between the two opposite web faces so that the moisture content of the surface to be calendered is caused to be higher than that of the web interior and than that surface of the web opposite the surface to be calendered. When the moisture distribution is desirably advantageous, the web is passed or advanced to the calender nip for calendering. The moldability characteristics of the web in the different transverse portions or regions along the web cross-section is thereby rendered notably more advantageous than the web moldability achievable or available in prior art arrangements in which the web, as calendered, is at best uniformly moist.

A calender apparatus constructed in accordance with preferred embodiments of the present invention—as for example a machine calender, soft calender or supercalender—is provided with suitable devices or elements for providing the conditions under which the predetermined transfer of moisture to the web is initiated within the web from one surface to the other. These devices or elements are constructed and operated so that the transfer process continues for a period sufficient to create the desired transverse moisture distribution in the web (depicted by way of example in FIG. 7B), or at least to assure that the web surface about to be brought into contact with a heated calender roll has a higher moisture content than the opposite web surface.

In accordance with these forms of the inventive method, a temperature difference is produced between the surfaces of a paper or board web by heating or cooling one of the web surfaces so that the surface to be glazed or calendered is at a lower temperature than the opposite web surface. By virtue of this temperature difference the aforementioned heat pipe process causes moisture present in the web to be transferred toward the cooler web surface which is then glazed by a hot face in a calendering nip defined, by way of example, by a heated roll forming the hot face and a second roll or other structure by which the web is pressed against the heated roll.

As will be appreciated, the advantageous operability of these preferred embodiments of the inventive method and apparatus is based on a known process or effect—i.e. the so-called heat pipe process—that takes place when a temperature difference is created between the opposite surfaces of a warm and moist sheet-like web whereby water contained in the web is caused to flow toward the cooler surface. The heat pipe process and its application to the drying of paper webs are described, by way of illustrative example, in several articles authored by Jukka Lehtinen, namely *The Heat Pipe Process In Intraweb Heat Transfer In Hot-Surface Paper Drying,* 74 Paperi ja Puu—Paper and Timber 560–61 (1992); *Some Structural Effects On The Diffusional And Fluid Flow Frictional Resistance Of Paper Webs Undergoing Hot-Surface Drying,* 1 Drying '86 332–40 (Hemisphere Publishing Corp. 1986); and *Further Development Of A Computer Program Simulating Heat Pipe Functioning In Condebelt Paper Drying,* 10 (4) Drying Technology 1037–62 (1992). In accordance with the present invention, the transverse distribution of moisture in and through the paper web is thereby varied so as to notably decrease the glass transition temperature of the web surface to be glazed through calendering and, at the same time, the glass transition temperature of the opposite surface of the web and of the web interior is increased as moisture is transferred within the web toward the cooler surface.

The heat pipe process is initiated, however, only under substantially airtight conditions so as to prevent the evaporation of moisture as the heat pipe process proceeds. In order to provide such conditions, the web may for example be passed or pressed between a roll and an impervious belt or between co-moving impervious belts.

Thus, the present invention is based, at least in part, on a specific recognition that the known heat pipe process may advantageously be applied to the calendering of a web, an application of that process neither taught nor suggested by the prior art.

Those skilled in the art will quite appreciate the many significant advantages provided by the method and apparatus of the present invention. The calendering properties of the surface of the web, for example, are considerably improved and, in the calendering operation, the bulk of the web is maintained since only those fibers at or closely proximate the web surface to be calendered more readily attain a plastic state. Furthermore, the web may be calendered without additional moistening and the corresponding need for increased drying capacity to account for the added moisture in the web.

It will also be recognized that the inventive method is particularly well-suited for use in on-line calendering, in which the paper entering the calender is hot and moist.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views:

FIGS. 7A and 7B are cross-sectional views of a paper web depicting the transverse moisture distribution in the web respectively before and after treatment of the web in accordance with the present invention.

DETAILED DESCRIPTION OF THE PREFERRED EMBODIMENTS

Figure 1:
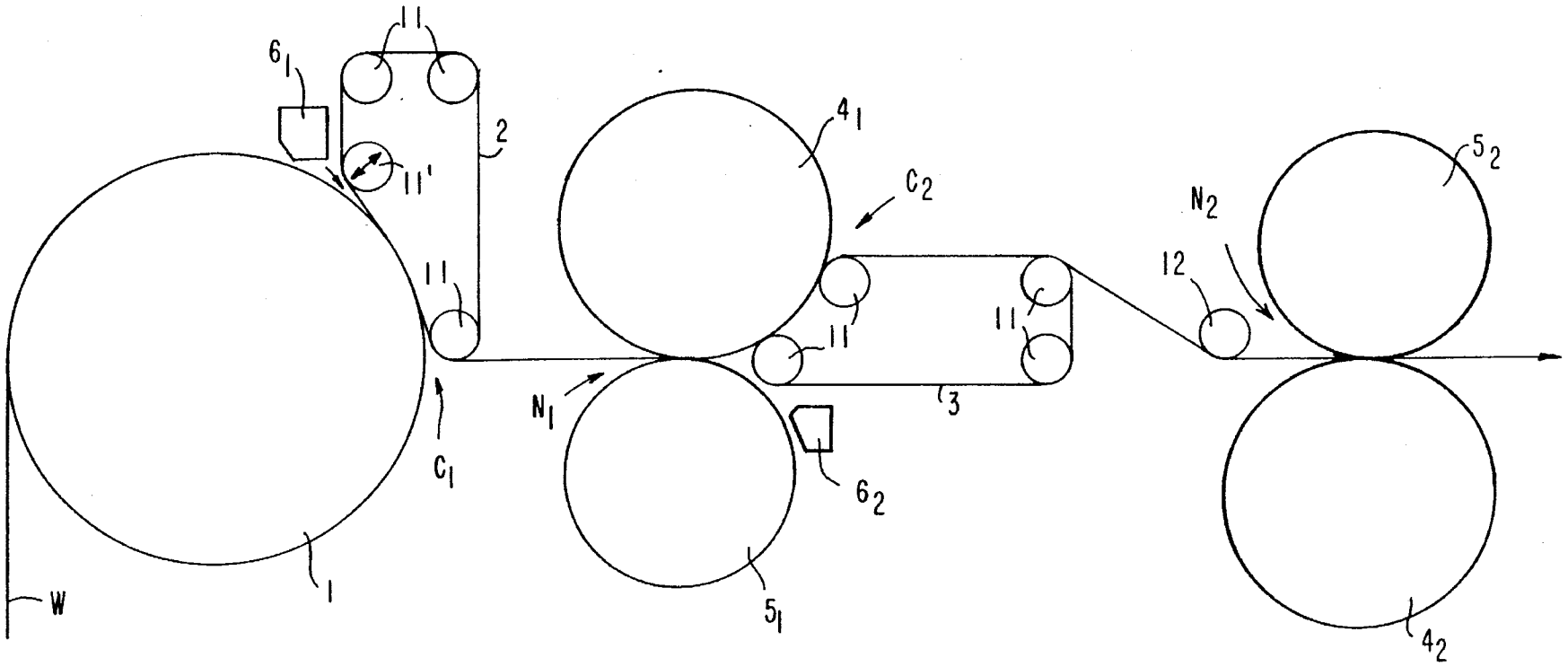
FIG. 1 is a schematic side view of a first embodiment of a calender apparatus constructed in accordance with the present invention and wherein the calendering nips are formed between pairs of rolls.

Shown in FIG. 1 is a first embodiment of a calender apparatus constructed in accordance with the present invention and with which the inventive method may be readily practiced. It will be recognized and appreciated that only those components of the calender necessary to the disclosure and to provide a statutorily sufficient and suitable description and understanding of the invention are specifically shown, and that the illustrated components are not intended to be depicted in other than a schematic or generally diagrammatic manner appropriate for facilitating a thorough understanding of the present invention.

With continued reference to FIG. 1, then, successive calendering nips $N_1$ and $N_2$ are formed between nip rolls $\mathbf{4}_1$, $\mathbf{5}_1$ and $\mathbf{4}_2$, $\mathbf{5}_2$, respectively. The first roll $\mathbf{4}_1$, $\mathbf{4}_2$ of each pair is a hard-faced roll that is heated in any conventional or otherwise appropriate manner and the second roll $\mathbf{5}_1$, $\mathbf{5}_2$ of each pair is a soft-faced roll that may, by way of example and as well known in the art, be provided with a suitable coating. As shown in this first illustrated embodiment, a hot and moist paper web W is passed or advanced from the last drying cylinder 1 of a drying group (not shown) into the first calendering nip $N_1$ formed by the opposed calender rolls $\mathbf{4}_1$, $\mathbf{5}_1$ so as to calender one side or face or surface of the web W, following which the web proceeds via a guide roll 12 into the second calendering nip $N_2$, formed by the opposed calender rolls $\mathbf{4}_2$, $\mathbf{5}_2$, for calendering of the opposite surface of the web.

An endless belt 2, guided by and about a plurality of guide rolls 11, is disposed in associated proximity with the surface of the drying cylinder 1 to form a first contact zone $C_1$ with the cylinder 1. A first guide roll 11' of the rolls 11, viewed from the incoming direction of the paper web W, is arranged for positional displacement (as indicated by the associated double-headed arrow in FIG. 1) so as permit adjustment of the length of the contact zone $C_1$ and corresponding guidance of the web. A steam pipe $\mathbf{6}_1$ or functionally-equivalent apparatus or device is located at or proximate the side of the contact zone $C_1$ at which the web enters the zone for blowing steam or the like into the contact zone $C_1$ to remove air from the zone and thereby prevent evaporation of moisture from the web during the heat pipe moisture transfer process.

A similar endless belt assembly is also provided in association with the first heated calender roll $\mathbf{4}_1$. An endless belt 3 is guided by and about a second set of guide rolls 11 adjacent the hot roll $\mathbf{4}_1$ on the downstream side of the first calendering nip $N_1$ to form a second contact zone $C_2$ with and against the roll $\mathbf{4}_1$. At the beginning of the zone $C_2$—i.e. at or proximate the end of the zone at which the web W enters—a steam pipe $\mathbf{6}_2$ or functionally-equivalent apparatus or device is similarly disposed for blowing steam or the like into the second contact zone $C_2$ for the removal of air from the zone as hereinabove noted.

Each of the belts 2, 3 may be cooled and, as indicated above, the drying cylinder 1 and the calender roll $\mathbf{4}_1$ are heated. A temperature difference is thus created between the opposite surfaces of the web W as the web advances into each contact zone $C_1$, $C_2$, whereby water contained in the web is caused by the heat pipe process or effect to flow toward the relatively cooler surface of the web, i.e. toward the respective belt 2, 3, as the web passes through each contact zone. The moisture content of that surface of the web W which is to be calendered is thereby increased and its glass transition temperature is reduced. The web surface to be calendered is then disposed or pressed against the heated calender roll $4_1$ or $4_2$ in the respective following (i.e. immediately downstream) calender nip $N_1$ or $N_2$. The placement of the steam pipes $6_1$, $6_2$ in close association with the belts 2, 3 for blowing steam into the adjacent contact zones $C_1$, $C_2$ is thus intended to remove air from the contact zones so as to initiate the heat pipe process.

Those skilled in the art will now readily understand and appreciate that numerous alternate configurations and constructions of calenders and of components for effecting calendering of a paper web—other than the particular construction depicted in FIG. 1 and hereinabove described—may be employed in accordance with the invention and as general matters of design choice, suitability to application and other factors independent of the teachings or practice of the invention. Alternate implementations of the inventive method and apparatus will accordingly now be described, by way of illustrative example, in conjunction with various additional calender constructions. Such additional constructions are, however, depicted only to the extent necessary to indicate the differences between such alternate constructions and that depicted in FIG. 1 so as facilitate a ready understanding of the intended scope of the invention and its application to such alternate constructions. The substitution of individual or collections of elements from any of the herein disclosed or described embodiments into any of the other herein disclosed or described embodiments is fully within the intended scope and contemplation of the invention.

Figure 2:
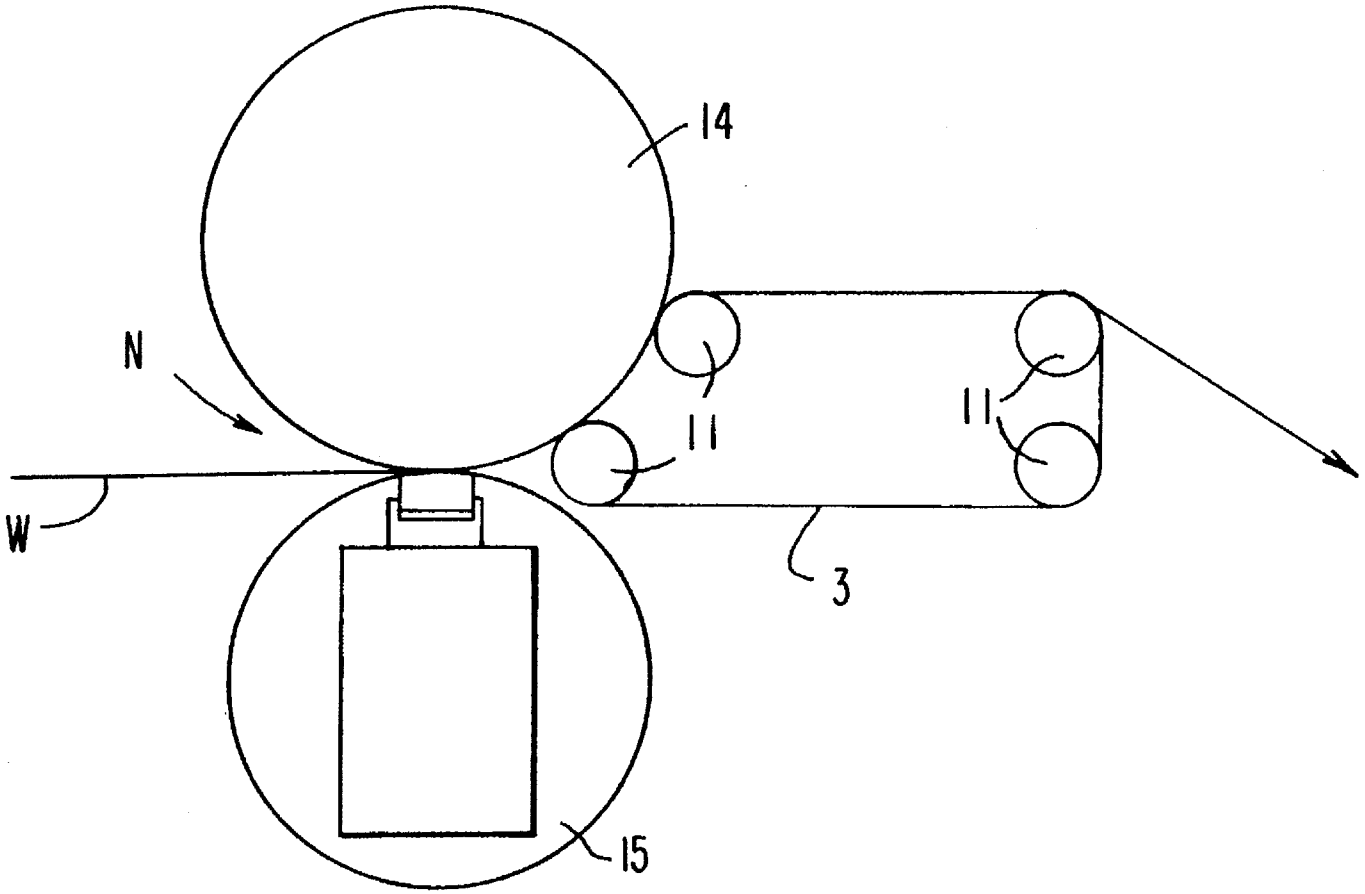
FIG. 2 is a schematic side view of a second embodiment of a calender apparatus constructed in accordance with the present invention and wherein the calendering nip is formed between a roll and an extended nip roll.

Thus, FIG. 2 depicts a first roll pair of a calender assembly in which the calendering nip N is formed between a hot calender roll 14 and an extended nip roll 15. In accordance with the present invention an endless belt 3, guided by and about guide rolls 11 and preferably cooled, is placed after (i.e. downstream of) the calendering nip N in the direction of web advancement. This construction produces a temperature difference between the opposite surfaces of the web W just prior to advancement of the web into the following (i.e. downstream) calendering nip (not shown).

Figure 3:
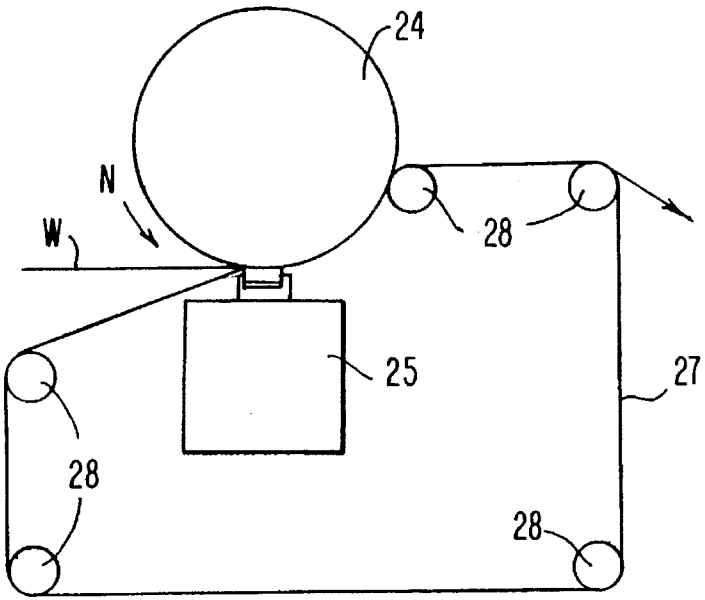
FIG. 3 is a schematic side view of a third embodiment of a calender apparatus constructed in accordance with the present invention and wherein the calendering nip is formed between a roll and a belt arrangement trained about guide rolls and an associated beam.

The calendering nip N of the embodiment of FIG. 3 is formed by and between the combination of a hot calender roll 24 and an endless belt 27 that is guided by and about guide rolls 28 and an associated beam 25. The present invention may be readily applied to this alternate nip-defining construction by creating, using any suitable apparatus or device—such, for example, as the belt arrangement shown in FIG. 1 or otherwise described in conjunction with the various embodiments herein disclosed—for creating a temperature difference between the surfaces of the web W before (i.e. upstream of) the nip N so that the surface to be calendered in the nip N is cooler than the opposite web surface and additionally, if desired, following (i.e. downstream of) the nip N so that the opposite surface of the web is relatively cooler for downstream calendering of the opposite surface in a succeeding nip (not shown).

Figure 4:
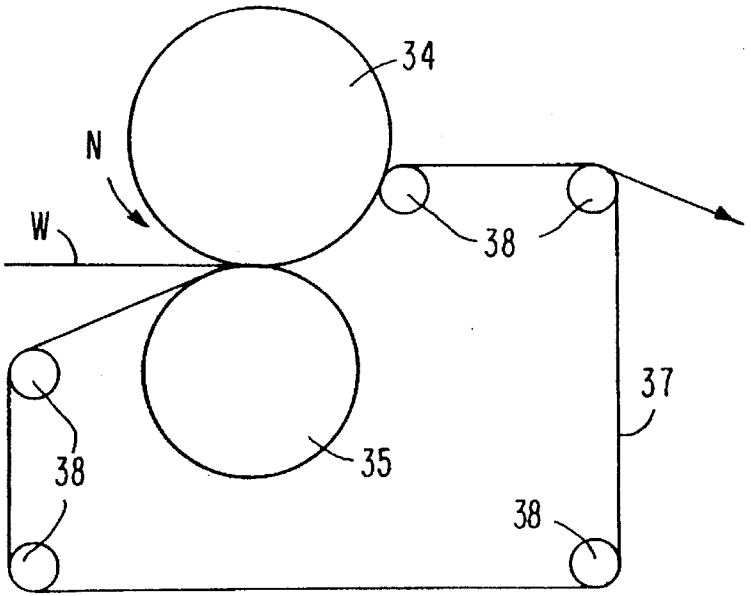
FIG. 4 is a schematic side view of a fourth embodiment of a calender apparatus constructed in accordance with the present invention and wherein the calendering nip is formed between a roll and a roll-belt arrangement.

FIG. 4 depicts yet another calendering nip N, in this case formed between a hot calender roll 34 and an arrangement consisting of a roll 35 and an endless belt 37. The belt 37 is guided by and about guide rolls 38 and disposed so that a portion of the belt is interposed between the rolls 34, 35. Here, as described in conjunction with FIG. 3, any suitable apparatus or arrangement for providing the desired temperature differential between the opposite surfaces of the web upstream and, optionally, downstream of the nip N may be employed in accordance with the invention as herein disclosed.

Figure 5:
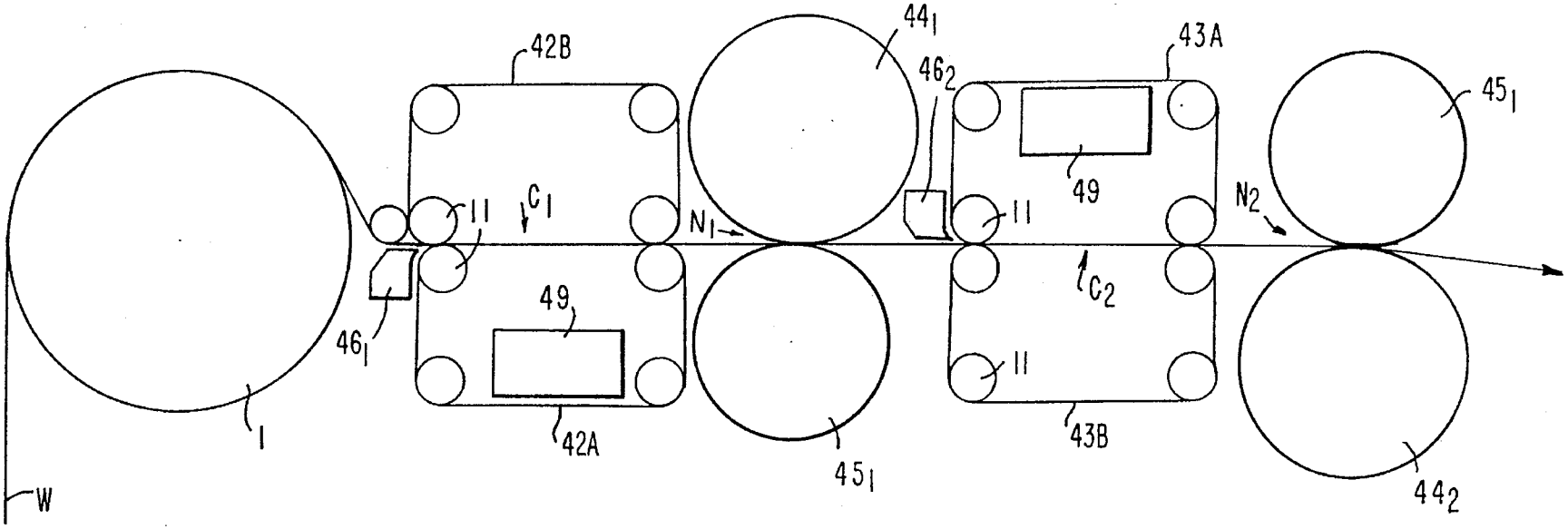
FIG. 5 is a schematic side view of a fifth embodiment of a calender apparatus constructed in accordance with the present invention and wherein the web is heated and/or cooled by moving belt systems.

The calender assembly shown in FIG. 5 is similar to that depicted in FIG. 1 and hereinabove described. In the FIG. 5 construction, however, an alternate arrangement for providing, in accordance with the present invention, a temperature difference between the web faces prior to advancement of the web into each calendering nip $N_1$, $N_2$ is provided. In this further embodiment, a cooling belt arrangement 42B, 43B is located along one side of the web W upstream of each respective calendering nip $N_1$, $N_2$ to cool the adjacent surface of the web, and a heating belt arrangement 42A, 43A is disposed along the other or opposite side of the web upstream of each respective nip $N_1$, $N_2$. A steam pipe $46_1$, $46_2$ or other functionally-equivalent device is provided just before (i.e. upstream of) each of the heating belt arrangements 42A, 43A for blowing steam into the contact zones $C_1$, $C_2$ defined between the respective heating belts and the web W so as to remove air from the zones $C_1$, $C_2$ and initiate the heat pipe process in those zones.

Figure 6:
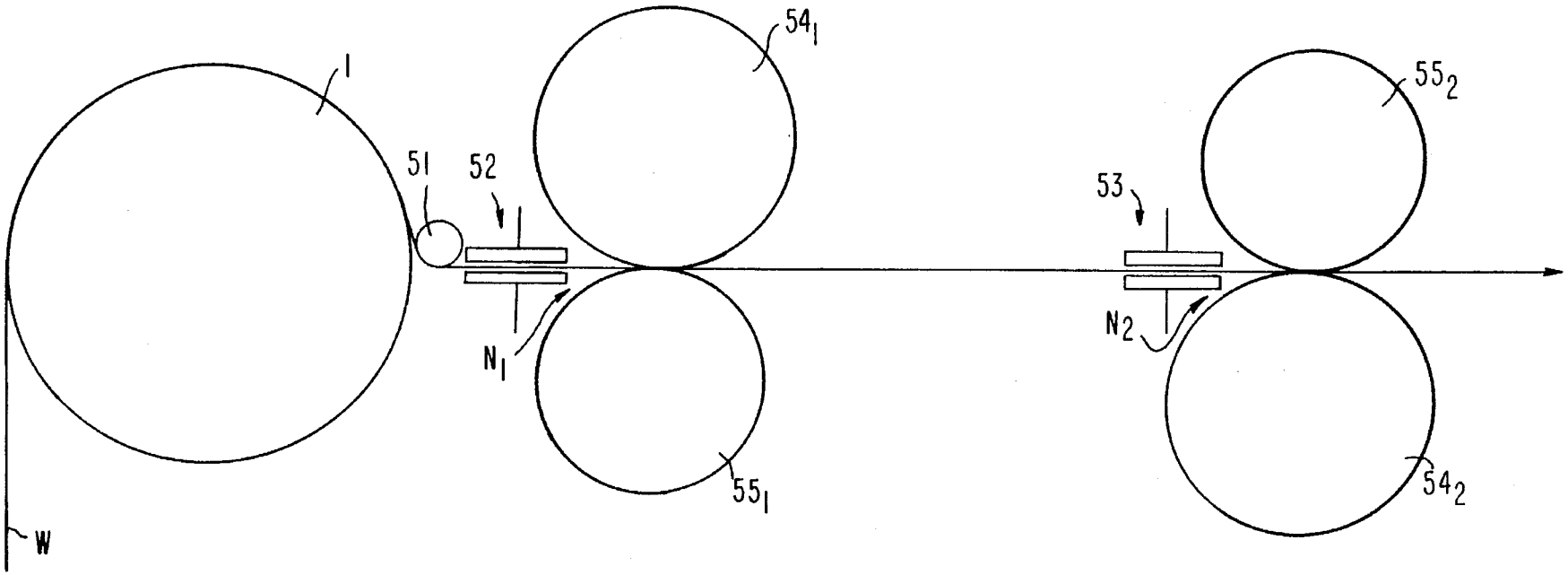
FIG. 6 is a schematic side view of a sixth embodiment of a calender apparatus constructed in accordance with the present invention and wherein the desired moisture profile in and through the web is created by electrostatic devices.

The calender embodiment of FIG. 6 provides the desired moisture distribution in and through the web in a somewhat different manner than the previously described embodiments. In the embodiment of FIG. 6, the moisture distribution is created through operation of a respective electrostatic device 52, 53 placed just before (i.e. upstream of) each calendering nip $N_1$, $N_2$. Each electrostatic device generates an electrostatic field by which water molecules in the web are transferred or moved within the web in the direction of the web surface to be calendered—i.e. toward the web surface to be brought into contact with the respective heated nip roll $54_1$, $54_2$. The calender construction is otherwise substantially in accordance with that shown in FIG. 1. Thus, a guide roll 51 redirects the web as it leaves the last drying roll 1, the first nip $N_1$ (which follows the electrostatic device 52) is defined between the calendering rolls $54_1$, $55_1$, and the second nip $N_2$ (which follows the electrostatic device 53) is formed between the calendering rolls $54_2$, $55_2$.

Figure 7A:
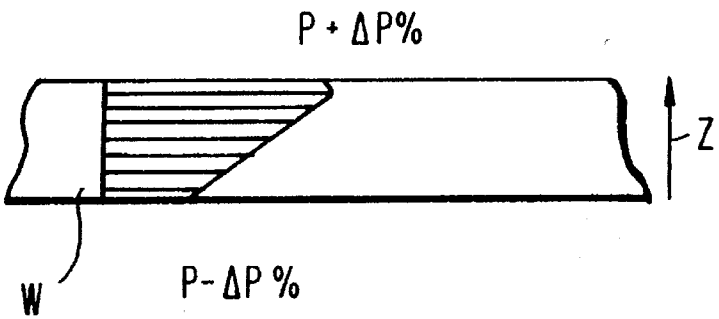
Figure 7A:
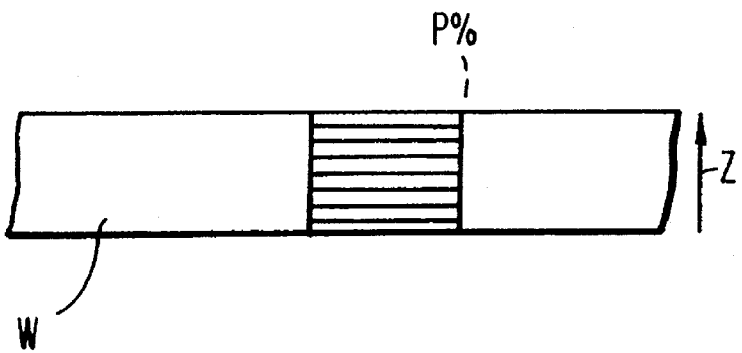

Shown in FIG. 7A is a typical transverse distribution of moisture in and as viewed through a cross-section of the web W prior to treatment of the web in accordance with the present invention. Thus, the FIG. 7A distribution depicts the moisture content as the web leaves, by way of example, the last or final drying cylinder 1 in the apparatus illustrated in FIG. 6. As is apparent, the moisture percentage $\rho$ is substantially uniform or nonvarying in and along the thickness direction of the web W over the distance Z defined between the opposite surfaces of the web.

FIG. 7B, on the other hand, depicts the distribution of moisture in the web W following treatment in accordance with the invention (and just prior to entry into the calendering nip) to provide a temperature differential between the web's opposite surfaces. As there shown, the moisture percentage $\rho$ of the relatively cooler surface of the web has increased to the value $\rho+\Delta\rho\%$, while the moisture percentage of the opposite or warmer surface of the web W has decreased to $\rho-\Delta\rho\%$. Significantly, the moisture content of the surface having the higher moisture content in FIG. 7B has increased beyond its moisture content prior to the inventive treatment and, accordingly, the glass transition temperature of that surface has decreased and will exhibit notably improved calendering properties. This higher moisture content surface will be disposed or pressed against the heated calender roll in the following (i.e. downstream) calender nip. In addition, the reduced moisture content of the opposite web surface, and the decreasing moisture content profile between the two surfaces within the web interior, reduces unintended effects of the calendering process on the web interior and on the opposite web surface.

When paper or board reaches the calendering process, its temperature is typically in the range of approximately 30 to 110 degrees C. and its moisture content is typically in the range of approximately 4 to 10 percent. Initiation of the inventive process requires no precise temperatures but, rather, merely a temperature differential. The inventive process partially utilizes the thermal energy contained in the paper or board.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A method of calendering a first surface of a predeterminately moist paper web in a calendering nip defined between a first heated member and a second member, comprising the steps of:

defining a temperature difference between the first surface of the web and a second surface of the web opposite said first surface such that the first surface is cooler than said second surface of the web;

effecting a transfer of moisture within the web from said second surface toward said relatively cooler first surface of the web while substantially preventing evaporation of moisture from the web so as to create a predetermined moisture profile transversely through the web and decrease a glass transition temperature of the web at said relatively cooler first surface; and advancing the web having said predetermined moisture profile into the calendering nip so that said relatively cooler first surface of the web is pressed against said first heated member to calender said first surface of the web.

2. A method of calendering a first surface of a paper web in accordance with claim 1, wherein said defining step and said effecting step are carried out substantially concurrently.

3. A method of calendering a first surface of a paper web in accordance with claim 1, wherein said defining step further comprises at least one of contacting the first surface of the web with a cooled contact surface and contacting the second surface of the web with a heated contact surface so as to define said temperature difference between the first and second surfaces of the web.

4. A method of calendering a first surface of a paper web in accordance with claim 3, wherein said defining step further comprises advancing said web through a contact zone defined between (1) said at least one of said cooled contact surface and said heated contact surface and (2) one of a third contact surface and the other of said at least one of said cooled contact surface and said heated contact surface, so as to define said temperature difference between the first and second surfaces of the web.

5. A method of calendering a first surface of a paper web in accordance with claim 4, wherein said effecting step further comprises directing steam into said contact zone from an end of said contact zone through which the web is advanced into said contact zone.

6. A method of calendering a first surface of a paper web in accordance with claim 4, wherein said defining step further comprises defining said contact zone such that the web is maintained in substantially airtight relation as the web is advanced through said contact zone.

7. A method of calendering a first surface of a paper web in accordance with claim 4, wherein said effecting step is carried out in said contact zone.

8. A method of calendering a first surface of a paper web in accordance with claim 1, wherein said defining step further comprises contacting the first surface of the web with a cooled contact surface and contacting the second surface of the web with a heated contact surface so as to define said temperature difference between the first and second surfaces of the web.

9. A method of calendering a first surface of a paper web in accordance with claim 8, wherein said defining step further comprises advancing the web through a contact zone defined between said first and second contact surfaces so as to define said temperature difference between the first and second surfaces of the web.

10. A method of calendering a first surface of a paper web in accordance with claim 9, wherein said effecting step further comprises directing steam into said contact zone from an end of said contact zone through which the web is advanced into said contact zone.

11. A method of calendering a first surface of a paper web in accordance with claim 9, wherein said defining step further comprises defining said contact zone such that the web is maintained in substantially airtight relation between said first and second contact surfaces as the web is advanced through said contact zone.

12. A method of calendering a first surface of a paper web in accordance with claim 9, wherein said effecting step is carried out in said contact zone.

13. A method of calendering a first surface of a paper web in accordance with claim 1, wherein said defining step further comprises contacting the first surface of the web with a cooled belt and contacting the second surface of the web with a heated roll face so as to define said temperature difference between the first and second surfaces of the web.

14. A method of calendering a first surface of a paper web in accordance with claim 13, wherein said defining step further comprises advancing said web through a contact zone defined between said cooled belt and said heated roll face so as to define said temperature difference between the first and second surfaces of the web.

15. A method of calendering a first surface of a paper web in accordance with claim 14, wherein said effecting step further comprises directing steam into said contact zone from an end of said contact zone through which the web is advanced into said contact zone.

16. A method of calendering a first surface of a paper web in accordance with claim 1, wherein said defining step further comprises contacting the first surface of the web with a cooled belt and contacting the second surface of the web with a heated belt so as to define said temperature difference between the first and second surfaces of the web.

17. A method of calendering a first surface of a paper web in accordance with claim 16, wherein said defining step further comprises advancing said web through a contact zone defined between said cooled belt and said heated belt so as to define said temperature difference between the first and second surfaces of the web.

18. A method of calendering a first surface of a paper web in accordance with claim 17, wherein said effecting step further comprises directing steam into said contact zone from an end of said contact zone through which the web is advanced into said contact zone.

19. Apparatus for calendering a first surface of a predeterminately moist paper web, comprising:

means for defining a temperature difference between the first surface of the web and a second surface of the web opposite said first surface such that the first surface is cooler than the second surface of the web;

means for effecting a transfer of moisture within the web from the second surface toward the relatively cooler first surface of the web while substantially preventing evaporation of moisture from the web so as to create a predetermined moisture profile transversely through the web and decrease a glass transition temperature of the web at the relatively cooler first surface; and a first heated member and a second member disposed relative to said first member so as to create a calendering nip through which the web having said predetermined moisture profile is advanced with the relatively cooler first surface of the web pressed by the second member against the first heated member to calender the first surface of the web.

20. Apparatus for calendering a first surface of a paper web in accordance with claim 19, wherein said temperature difference defining means comprises at least one of first means for cooling the first surface of the web and second means for heating the second surface of the web so as to define said temperature difference between the first and second surfaces of the web.

21. Apparatus for calendering a first surface of a paper web in accordance with claim 19, wherein said temperature difference defining means comprises first means for cooling the first surface of the web and second means for heating the second surface of the web so as to define said temperature difference between the first and second surfaces of the web.

22. Apparatus for calendering a first surface of a paper web in accordance with claim 21, wherein said effecting means comprises means locating said first and second means so as to define a substantially airtight contact zone between said first and second means and within which moisture within the web is transferred from the second surface toward the relatively cooler first surface of the web so as to create said predetermined moisture profile transversely through the web as the web is advanced through said contact zone.

23. Apparatus for calendering a first surface of a paper web in accordance with claim 22, said effecting means further comprising means for directing steam into said contact zone from an end of said contact zone through which the web is advanced into the contact zone.

24. Apparatus for calendering a first surface of a paper web in accordance with claim 22, wherein said first means comprises a cooled belt and said second means comprises a heated roll.

25. Apparatus for calendering a first surface of a paper web in accordance with claim 22, wherein said first means comprises a cooled belt and said second means comprises a heated belt.

26. Apparatus for calendering a first surface of a paper web in accordance with claim 25, wherein each of said first and second belts are substantially fluid-impervious so as to maintain said substantially airtight contact zone between said first and second belts.

27. A method of calendering a first surface of a predeterminately moist paper web in a calendering nip defined between a first heated member and a second member, comprising the steps of:

effecting a transfer of moisture within the web from a second surface of the web opposite said first surface toward said first surface of the web so as to define a greater moisture content in said first surface of the web than in said second surface of the web and thereby create a predetermined moisture profile transversely through the web and decrease a glass transition temperature of the web at said relatively first surface; and advancing the web having said predetermined moisture profile into the calendering nip so that said relatively moister first surface of the web is pressed against said first heated member to calender said first surface of the web.

28. A method of calendering a first surface of a paper web in accordance with claim 27, wherein said effecting step comprises subjecting the web to an electrostatic field for transferring water molecules in the web toward the first surface to thereby create the predetermined moisture profile transversely through the web.

29. A method of calendering a first surface of a paper web in accordance with claim 27, further comprising the step of defining a temperature difference between the first surface of the web and the second surface of the web such that the first surface is cooler than said second surface of the web, and wherein said effecting step further comprises effecting a transfer of moisture within the web from said second surface toward said relatively cooler first surface of the web while substantially preventing evaporation of moisture from the web so as to create said predetermined moisture profile transversely through the web.

* * * * *